US008308827B2

(12) United States Patent
Thiel et al.

(10) Patent No.: US 8,308,827 B2
(45) Date of Patent: Nov. 13, 2012

(54) DIESEL FUEL COMPOSITION

(75) Inventors: C. Yvonne Thiel, Carmel, NY (US); Thomas E. Hayden, Wappingers Falls, NY (US)

(73) Assignee: Texaco, Inc., San Roman, CA (US)

( * ) Notice: Subject to any disclaimer, the term of this patent is extended or adjusted under 35 U.S.C. 154(b) by 353 days.

(21) Appl. No.: 12/655,934

(22) Filed: Jan. 11, 2010

(65) Prior Publication Data

US 2010/0107483 A1 May 6, 2010

Related U.S. Application Data

(62) Division of application No. 10/779,423, filed on Feb. 13, 2004, now abandoned.

(51) Int. Cl.
*C10L 1/18* (2006.01)
*C10L 1/22* (2006.01)

(52) U.S. Cl. ..... 44/329; 44/333; 44/335; 44/336; 44/340; 44/343; 44/424; 44/426; 44/429; 44/430

(58) Field of Classification Search ..... 44/329, 44/333, 335, 336, 340, 343, 424, 426, 429, 44/430
See application file for complete search history.

(56) References Cited

U.S. PATENT DOCUMENTS

| | | | | |
|---|---|---|---|---|
| 4,320,019 | A * | 3/1982 | Hayashi | 508/234 |
| 4,919,683 | A | 4/1990 | Nalesnik et al. | |
| 5,075,383 | A | 12/1991 | Migdal et al. | |
| 5,925,151 | A | 7/1999 | DeCanio et al. | |
| 2004/0014612 | A1 | 1/2004 | Esche, Jr. et al. | |

FOREIGN PATENT DOCUMENTS

| | | |
|---|---|---|
| EP | 0 338 672 | 10/1989 |
| EP | 0 446 510 | 9/1991 |
| EP | 0 515 152 | 11/1992 |
| EP | 0 909 805 | 4/1999 |
| EP | 0 922 752 | 6/1999 |

* cited by examiner

*Primary Examiner* — Cephia D Toomer

(57) ABSTRACT

A diesel fuel containing a soot dispersant additive which is a grafted and derivatized low molecular weight copolymer of ethylene and at least one $C_3$-$C_{10}$ alpha monoolefin is provided. Also provided is a method for improving the fuel economy of a diesel engine which comprises operating the diesel engine with a fuel composition comprising (a) a major amount of a diesel fuel and (b) a minor fuel economy improving effective amount of the soot dispersant additive.

16 Claims, 1 Drawing Sheet

DIESEL FUEL COMPOSITION

This application is a divisional of U.S. Pat. application No. 10/779,423, filed Feb. 13, 2004 now abandoned , the contents of which are incorporated herein by reference.

BACKGROUND OF THE INVENTION

1. Technical Field

The present invention relates generally to a diesel fuel composition containing a soot dispersant additive which is a grafted and derivatized low molecular weight copolymer of ethylene and at least one $C_3$-$C_{10}$ alpha monoolefin.

2. Description of the Related Art

The diesel engine is a common powerplant choice when economic factors such as fuel economy, durability and efficiency are prime considerations. To extract the greatest utility from a diesel engine, lubricant drain intervals are often extended in commercial applications to minimize unproductive downtime for maintenance. The limit of a diesel engine's drain interval length is often related to the level of exhaust particulates that accumulate in the lubricant. While lubricant additive formulations are designed to accept and manage certain amounts of soot, when that capability is depleted, soot particle agglomeration may cause a sudden, significant viscosity increase, aggravate engine wear, handicap low temperature operation, form harmful sludge and result in a fuel economy penalty. Exhaust gas recirculation (EGR) exacerbates soot accumulation and further taxes the oil's performance over time.

A unique approach to extending the service life of a diesel engine lubricant and, consequently, increasing the economy of engine operation, is to introduce a predetermined amount of soot dispersant additive into the fuel with the object of having such additive become incorporated into the lubricant during engine operation in an amount and at a rate which will make up at least in part for the normal and expected consumption of soot dispersant additive that had previously been added directly to the lubricant in accordance with known and conventional practice.

However, the inherent nature of diesel engine operation raises several technical hurdles to a successful realization of this approach. In order to become incorporated into the lubricant, soot dispersant additive present in the fuel must pass through the combustion chamber with its chemical integrity intact and accumulate in the crankcase where it can then replenish the soot dispersant additive that has been consumed. The major technical problem to overcome is that the very nature of a diesel engine minimizes the opportunity for typical fuel additives to reach the cylinder wall. Specifically, the exposure of a compression ignition engine's cylinder to diesel fuel prior to combustion is very short relative to those timeframes encountered in gasoline engines. Moreover, in diesel engine operation, the fuel spray is directed at the piston, not the cylinder wall as in gasoline engine operation. Therefore, diesel fuel additive candidates must possess a different set of physical and chemical qualities to reach the oil coated cylinder surfaces than those requires in gasoline engine applications.

Possibly because of the aforementioned technical challenges, it is believed that the practice up until now has been one of directly adding soot dispersant additive solely to the diesel engine lubricant and not to the fuel.

Accordingly, there is a need for a diesel fuel which contains a soot dispersant additive capable of passing intact into the diesel lubricant so as to continuously replenish dispersant additive as the latter is consumed during the normal course of engine operation.

SUMMARY OF THE INVENTION

In accordance with one embodiment of the present invention, there is provided a diesel fuel composition comprising an effective amount of soot dispersant additive which is a copolymer of ethylene, a $C_3$-$C_{10}$ alpha-monoolefin and, optionally, a non-conjugated diene and/or triene, having a number average molecular weight ranging from about 5,500 to about 60,000 on which has been grafted an ethylenically unsaturated carboxylic acid and/or anhydride thereof in the ratio of at least about 1.8 molecules of carboxylic acid functions per molecule of the copolymer which is then further derivatized with at least one aminoaromatic polyamine compound selected from the group consisting of (a) N-arylphenylenediamine of the formula:

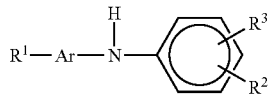

wherein Ar is an aromatic; $R^1$ is H or —NHaryl, —NHarylalkyl, a branched or straight chain radical having from 4 to about 24 carbon atoms that can be alkyl, alkenyl, alkoxyl, aralkyl alkaryl, hydroxyalkyl or aminoalkyl; $R^2$ is —$NH_2$, —$[NH(CH_2)_n—]_m—NH_2$, —$CH_2—(CH_2)_n—NH_2$, —$CH_2$-aryl-$NH_2$-aryl-$NH_2$ in which n and m each independently has a value of from 1 to about 10; and $R^3$ is H or an alkyl, alkenyl, alkoxy, aralkyl or alkaryl radical having from 4 to about 24 carbon atoms, (b) aminocarbazole of the formula:

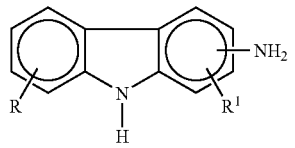

wherein R and $R^1$ each independently represents H or an alkyl or alkenyl radical having from 1 to about 14 carbon atoms, (c) aminoindole of the formula:

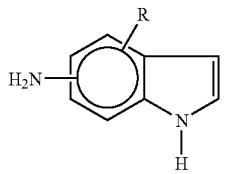

wherein R represents H or an alkyl radical having from 1 to about 14 atoms, (d) amino-indazolinone of the formula:

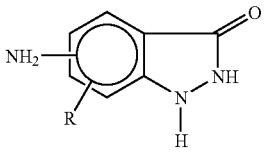

wherein R is H or an alkyl radical having from 1 to about 14 carbon atoms, (e) aminomercaptotriazole of the formula:

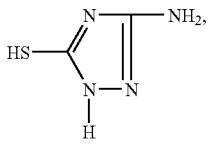

and (f) aminoperimidine of the formula:

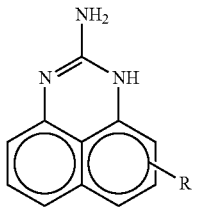

wherein R represents H or an alkyl radical having from 1 to about 14 atoms.

In accordance with another embodiment of the present invention, a method for improving the fuel economy of a diesel engine is provided comprising operating the diesel engine with a fuel composition comprising (a) a major amount of a diesel fuel and (b) a minor fuel economy improving effective amount of the foregoing soot dispersant additive.

Dispersant additives of the foregoing type and their preparation are described in U.S. Pat. No. 5,075,383, the contents of which are incorporated by reference herein. These additives when added to diesel fuel have been found herein to reach the cylinder lining of a diesel engine prior to fuel combustion and from there to enter the crankcase where they continuously replenish the lubricant's soot dispersing capability as its original dispersant additive is consumed. This replenishment capability results in the lubricant maintaining its viscometric characteristics over a longer drain interval than would be the case were no soot dispersant additive incorporated into the fuel.

In addition to the longer lubricant drain intervals mentioned, operation of a diesel engine with the soot dispersant additive-containing fuel of this invention has resulted in an unexpected and significant increase in fuel economy which is yet another benefit of employing the fuel of this invention in the operation of a diesel engine.

BRIEF DESCRIPTION OF THE DRAWINGS

Various embodiments are described below with reference to the drawings wherein.

DETAILED DESCRIPTION OF THE PREFERRED EMBODIMENTS

Figure 1:
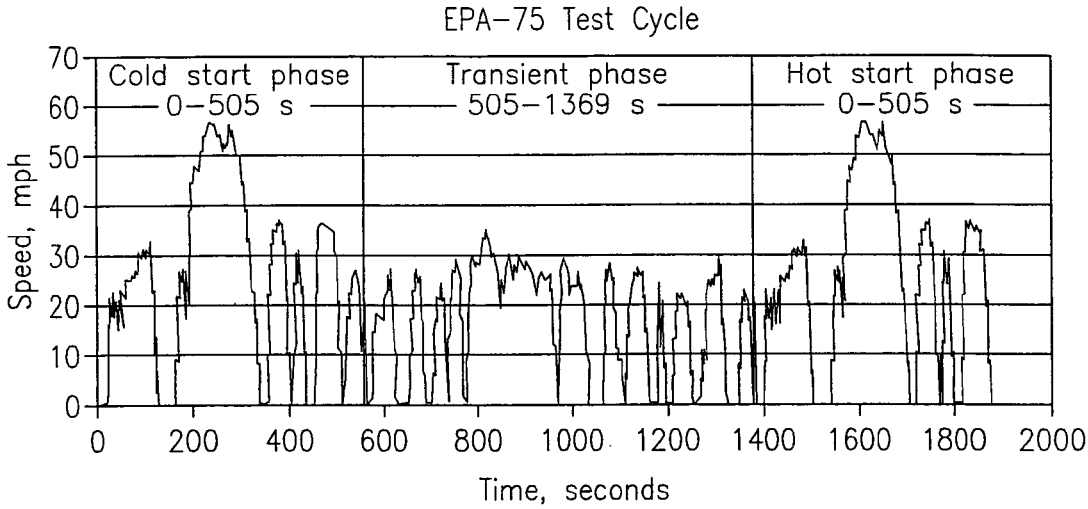
FIG. 1 is a graphical representation of the speed vs. time of an EPA-75 Test Cycle; and, FIG. 2 is a graphical representation of the speed vs. time of an EPA Highway Fuel Economy Driving Schedule.

The copolymer utilized in the manufacture of the soot dispersant additive which is employed in the diesel fuel composition of the present invention can be prepared from ethylene and at least one $C_3$-$C_{10}$ alpha-monoolefin such as propylene. Optionally, the ethylene and higher alpha-monoolefin(s) can be copolymerized with a polyene monomer selected from among the non-conjugated dienes and trienes to provide a terpolymer. The non-conjugated diene component can be one containing from 5 to about 14 carbon atoms in the chain. Preferably, the optional diene monomer is characterized by the presence of a vinyl group in its structure and can include, for example, cyclic and bicyclo compounds. Representative dienes include, but are not limited to, 1,4-hexadiene, 1,4-cyclohexadiene, dicyclopentadiene, 5-ethylidene-2-norbornene, 5-methylene-2-norbornene, 1,5-heptadiene and 1,6-octadiene. A mixture of dienes can also be used in the preparation of the copolymer. A preferred non-conjugated diene for preparing a base terpolymer is 1,4-hexadiene.

A triene monomer, when employed, will advantageously possess at least two non-conjugated double bonds and up to about 30 carbon atoms in the chain. Some useful trienes for preparing the base terpolymer are 1-isopropylidene-3a,4,7,7a-tetrahydroindene, 1-isopropylidenedicyclopentadiene, dehydroisobicyclopentadiene and 2-(2-methylene-4-methyl-3-pentenyl)[2.2.1]bicyclo-5-heptene.

The polymerization process for forming the base copolymer generally utilizes a catalyst in a solvent medium. The solvent can be any suitable inert organic solvent that remains liquid under the reaction conditions that are typical for the solution polymerization of monoolefins employing a Ziegler type catalyst. Examples of useful solvents include straight chain paraffins containing from 5 to 8 carbon atoms with hexane being preferred. Also useful are aromatic hydrocarbons, preferably aromatic hydrocarbons possessing a single benzene nucleus such as benzene, toluene, xylene, and the like, and saturated cyclic hydrocarbons having boiling point ranges approximating those of the aforementioned straight chain paraffinic hydrocarbons and aromatic hydrocarbons. The solvent selected can be a mixture of one or more of the foregoing hydrocarbons. It is desirable that the solvent be free of substances that may interfere with a Ziegler-type polymerization reaction.

In a typical preparation of a copolymer substrate, in this case, a terpolymer of ethylene, propylene and the diene monomer 5-ethylidene-2-norbornene, hexane is first introduced into a reactor and the temperature in the reactor is gradually raised to about 30° C. Dry propylene is then fed to the reactor until the pressure reaches about 40 to about 45 inches of mercury. The pressure is thereafter increased to about 60 inches of mercury at which point dry ethylene and 5-ethylidene-2-norbornene are introduced to the reactor. At the conclusion of the monomer feeds, a catalytic mixture of aluminum sesquichloride and vanadium oxytrichloride is added to initiate polymerization. Completion of the polymerization reaction is indicated by a drop in the reactor pressure.

Ethylene-propylene or higher alpha-monoolefin copolymers can consist of from about 15 to about 80 mole percent ethylene and from about 20 to about 85 mole percent propylene or higher monoolefin with the preferred proportions being from about 25 to about 75 mole percent ethylene and from about 25 to about 75 mole percent of a $C_3$-$C_{10}$ alpha-monoolefin with the most preferred proportions being from about 25 to about 55 mole percent propylene and about 45 to about 75 mole percent ethylene.

Terpolymer variations of the foregoing polymers can contain from about 0.1 to about 10 mole percent of a nonconjugated diene or triene.

The starting base copolymer/terpolymer for preparing the soot dispersant additive of the invention is an oil-soluble, substantially linear, rubbery material having a number average molecular weight ranging from about 5,500 to about 60,000, preferably from about 6,000 to about 20,000 and more preferably from about 7,000 to about 15,000. Many polymerization processes produce copolymers and terpolymers having number average molecular weights substantially above 80,000, e.g., in the range of from about 100,000 to about 300,000 and even higher. For use in the manufacture of the soot dispersant additive herein, such high molecular weight copolymers/terpolymers must be reduced in molecular weight so as to fall within the aforestated number average molecular weight range of from about 5,500 to about 60,000.

High molecular weight copolymers/terpolymers such as those containing from about 40 to about 60 mole percent ethylene units and about 60 to about 40 mole percent propylene units are available commercially. Examples of such polymers are Ortholeum 2052 and PL-1256 both available from E.I. duPont deNemours and Co. Ortholeum 2052 is a terpolymer containing about 48 mole percent ethylene units, 48 mole percent propylene units and 4 mole percent 1,4-hexadiene units and having an inherent viscosity of 1.35 and PL-1256 is a similar polymer with an inherent viscosity of 1.95. The number average molecular weights of these polymers are on the order of about 200,000 and about 280,000, respectively.

The term "copolymer" is used herein to encompass both copolymers, terpolymers and interpolymers. These polymeric materials can contain minor amounts of other olefinic monomers provided their basic characteristics are not materially changed.

An ethylenically unsaturated carboxylic acid or source of carboxylic acid functionality is grafted onto the copolymer backbone. These reactants contain at least one ethylenic bond and at least one, and preferably two, carboxylic acid groups, an anhydride group or a polar group which is convertible into a carboxylic acid group by oxidation or hydrolysis. Maleic anhydride or a derivative thereof is preferred. This and similar anhydrides graft onto the base copolymer or terpolymer to provide two carboxylic acid functionalities. Examples of additional unsaturated carboxylic acid reactants include acrylic acid, methacrylic acid, cinnamic acid, crotonic acid, 2-phenylpropenoic acid, maleic acid, fumaric acid, glutaconic acid, mesaconic acid, itaconic acid (methylene succinic acid), citraconic acid (methyl maleic acid), chloromaleic acid, anhydrides such as chloromaleic anhydride, glutaconic anhydride, itaconic anhydride, citraconic anhydride and derivatives such as their esters and corresponding acyl halides.

The reduction of the molecular weight of a base copolymer having a number average molecular weight above about 80,000 to a number average molecular weight within the range of from about 5,500 to about 60,000 (a molecular weight range corresponding to about 300 to about 25,000 cSt kinetic viscosity of a 37% concentrate of the finished dispersant) and the grafting of the ethylenically unsaturated carboxylic acid reactant onto the copolymer can be accomplished simultaneously or sequentially in any order. If carried out sequentially, the base copolymer can first be degraded to come within the prescribed molecular weight and then grafted or, conversely, the grafting can be effected onto the high molecular weight copolymer followed by degrading the resulting high molecular weight grafted copolymer to within the aforesaid number average molecular weight range. Alternatively, grafting and reduction of the high molecular weight copolymer can be achieved concurrently.

Reduction of the weight average molecular weight of the high molecular weight copolymer to within the prescribed molecular weight range, whether during or prior to grafting, can be conducted in the presence or absence of a solvent or other neutral medium by means of mechanical shearing. Generally, the copolymer is heated to a molten condition at a temperature in the range of from about 250° C. to about 450° C. and is thereafter subjected to mechanical shearing until the number average molecular weight is reduced to within the prescribed number average molecular weight range. The shearing can be effected by forcing the molten copolymer through fine orifices under pressure or by other mechanical means.

The grafting of the ethylenically unsaturated carboxylic acid and/or anhydride onto the copolymer either before or after the copolymer is reduced in molecular weight or during the shearing of the copolymer can be conducted in the presence of a free radical initiator.

The amount of carboxylic acid reactant that is grafted onto the copolymer backbone is critical. Thus, at least about 1.8 molecules of the carboxylic acid or anhydride must be reacted with each molecule of the polymer backbone. It is preferred to react the two or more moles of the carboxylic acid or anhydride with an equivalent amount of copolymer. Broadly, the carboxylic acid or anhydride should be employed in a ratio from about 1.8 to about 5 molecules per molecule of the polymer backbone with a preferred ratio being from about 2 to about 5 molecules and a still more preferred ratio being from about 2.25 to about 4 molecules. Highly effective dispersant additives generally have from about 2.5 molecules to about 3.5 molecules of the carboxylic acid or anhydride grafted onto each copolymer molecule.

The free-radical initiators which can be used in the grafting reaction are peroxides, hydroperoxide and azo compounds, preferably those having a boiling point greater than about 100° C. and thermally decomposing within the grafting temperature range to provide free radicals. Representative of these free-radical initiators include, but are not limited to, azobutyronitrile and 2,5-dimethylhex-3-yne-2,5 bis-tertiary-butyl peroxide. The initiator is generally used in an amount of from about 0.005% to about 1% by weight based on the weight of the reaction mixture solution. The grafting is preferably carried out in an inert atmosphere such as nitrogen. The resulting copolymer intermediate is characterized by having carboxylic acid acylating functions incorporated within its structure.

The grafted copolymer or mixture of grafted copolymers possessing carboxylic acid acylating functionality is then reacted with at least one aminoaromatic polyamine selected from the group consisting of:

(a) N-arylphenylenediamine of the formula:

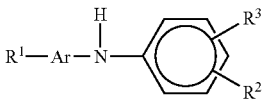

wherein Ar is aromatic and $R^1$ is H or —NHaryl, —NHarylalkyl, a branched or straight chain radical having from 4 to about 24 carbon atoms that can be alkyl, alkenyl, alkoxyl, aralkyl alkaryl, hydroxyalkyl or aminoalkyl; $R^2$ is —$NH_2$, —$[NH(CH_2)_n—]_m—NH_2$, —$CH_2—(CH_2)_n—NH_2$, —$CH_2$-aryl-$NH_2$-aryl-$NH_2$ in which n and m each has a value of from 1 to about 10; and, $R^3$ is H or an alkyl, alkenyl, alkoxyl, aralkyl or alkaryl radical having from 4 to about 24 carbon atoms, (b) aminocarbazole of the formula:

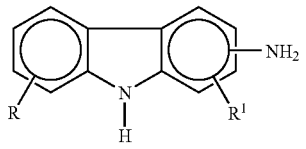

wherein R and $R^1$ each independently represents H or an alkyl or alkenyl radical having from 1 to about 14 carbon atoms, (c) aminoindole of the formula:

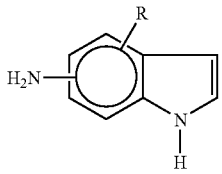

wherein R represents H or an alkyl radical having from 1 to about 14 atoms, (d) amino-indazolinone of the formula:

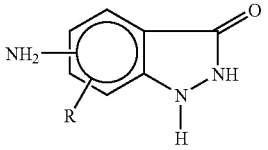

wherein R is H or an alkyl radical having from 1 to about 14 carbon atoms, (e) aminomercaptotriazole of the formula:

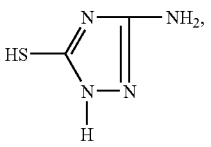

and (f) aminoperimidine of the formula:

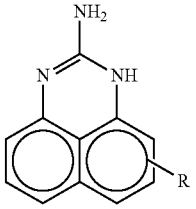

wherein R represents H or an alkyl radical having from 1 to about 14 atoms.

Particularly preferred N-arylphenylenediamines are the N-phenylphenylenediamines, for example, N-phenyl-1,4-phenylylenediamine, N-phenyl-1,3-phenylenediamine, N-phenyl-1,2-phenylenediamine, N-naphthylphenylenediamine, N-phenyl-naphthalenediamine and N'-aminopropyl-N-phenylphenylenediamine. Additional useful amines include aminocarbazole, aminoindole, aminoperimidine and aminomercaptotriazide.

The reaction between the copolymer intermediate(s) having grafted thereon carboxylic acid acylating functionality and the amino-aromatic polyamine(s) can be effected by heating a solution of the polymer substrate under inert conditions and then adding the amino-aromatic polyamine(s) to the heated solution generally accompanied by mixing. It is convenient to employ an oil solution of the copolymer heated to within about 140° C. to about 175° C. while maintaining the solution under a nitrogen blanket. The amino-aromatic polyamine reactant(s) is added to this solution and the reaction is carried out under the aforenoted conditions. In general, the amino-aromatic polyamine compound can be reacted with the grafted copolymer intermediate(s) in a ratio of about 0.5:1 to about 1.1:1 molar equivalence and preferably in a ratio of about 0.9:1 to about 1:1 molar equivalence of amino-aromatic polyamine compound to grafted copolymer intermediate(s).

The diesel fuel composition of the invention comprises a major portion of a middle distillate fuel oil boiling in the range of from about 340° F. to about 620° F. Diesel fuels containing less than about 500 parts per million (ppm) sulfur are generally regarded as low sulfur diesel fuels. The soot dispersant additive of this invention is advantageously added to a diesel fuel in an amount sufficient to replace at least part of the soot dispersant additive present in the crankcase oil as the latter additive is consumed during diesel engine operation. In general, the diesel fuel will contain from about 50 ppm to about 5,000 ppm and preferably from about 100 ppm to about 2,000 ppm of the soot dispersant additive.

The soot dispersant additive can, if desired, be combined with a suitable diluent, e.g., an aromatic hydrocarbon such as toluene or xylene, prior to addition to the diesel fuel. The diluent when utilized can be present in the dispersant additive composition in an amount of, e.g., from about 20 to about 50 weight percent and preferably in an amount of from about 25 to about 35 weight percent.

The diesel fuel composition of the present invention can also contain one or more other additives in addition to the soot dispersant additive. These additional additives include, but are not limited to, detergents, cetane improvers, antioxidants, carrier fluids, metal deactivators, dyes, markers, corrosion inhibitors, biocides, antistatic additives, drag reducing agents, demulsifiers, dehazers, anti-icing additives, lubricity additives, combustion improvers, and the like, in known and conventional amounts.

The following non-limiting examples are illustrative of the diesel fuel composition of the present invention.

EXAMPLE 1

Preparation of Dispersant-Antioxidant from Ethylene-Propylene Copolymer Grafted with 3.6 Wt. Percent Maleic Anhydride To a 1 liter cylindrical reaction flask was added 513 grams of ShellSol AB (an inert solvent) and 70 grams ethylene-propylene copolymer (number average molecular weight of 57,000) grafted with 3.61% maleic anhydride (2.52 grams). The mixture was heated to 110° C. under a nitrogen atmosphere and stirred until dissolved. N-phenyl-p-phenylenediamine (2.6 grams) was added and the mixture was heated to 160° C. under a Dean-Stark moisture separator. The temperature was maintained at 160° C. for 3 hours, and then checked by Infrared spectroscopy to verify complete conversion of the anhydride to the imide. Additional increments of N-phenyl-p-phenylenediamine (0.7 grams, 0.7 grams, 0.65 grams) were added, each followed by a 3 hour heating period at 160° C., and a verification of reaction completion by infrared spectroscopy. In order to prepare solvent free product for analysis, half of the reaction mixture was poured into acetone (3 liters) with vigorous stirring to precipitate the product as a rubber. The precipitated rubber was washed 2 times with acetone (3 liters, 3 liters) then filtered and dried overnight in a vacuum oven at 105° C.

EXAMPLE 2

The diesel engine test study described in this example was carried out in order to evaluate the capability of the soot dispersant additive of this invention to accumulate in the lubricating oil in the crankcase during engine operation.

The test fuel was a low sulfur base diesel fuel containing 309 ppm by weight of the soot dispersant additive prepared in Example 1. The test lubricating oil was a simple blend of a solvent neutral oil 150 (SNO 150) containing 1.2 weight percent of zinc dialkyldithiophosphate (as an antiwear additive) such that the oil's phosphorus content equaled 0.101 weight percent.

The test engine was a Honda diesel generator Model HRL 5500. The testing method was as follows:

| Step | Procedure |
|---|---|
| 1 | A double oil flush was performed as follows:<br>a) SNO-150 flush oil was weighed to the full mark (approximately 0.750 kg.).<br>b) The engine was started and run at idle for approximately 3 minutes.<br>c) Engine speed was increased to full throttle (no load) for 15 minutes.<br>d) The engine was shut down.<br>e) A vacuum bottle was used to remove oil from the crankcase.<br>f) The drain oil was discarded.<br>g) Procedures (a) through (f) were repeated. |
| 2 | The test fuel tank was drained, flushed with approximately 1 quart of Howell LSRD fuel, drained again and the drained fuel discarded. |
| 3 | The test tank was filled with test diesel fuel and the weight recorded at the start of the test. |
| 4 | The test oil (approximately 0.750 kg.) was weighed to the full mark and its exact weight recorded. |

-continued

| Step | Procedure |
|---|---|
| 5 | The engine was started using the test fuel tank. |
| 6 | A 1500-watt heater was turned on and operated for 5 minutes. |
| 7 | Exhaust back pressure (EBP) was adjusted to 25 inches $H_2O$ and a Bosch Smoke reading taken. |
| 8 | The engine was run for 15 minutes. |
| 9 | The EBP was adjusted to 25 inches $H_2O$ and 3 Bosch Smoke readings taken. |
| 10 | RPM, exhaust gas temperature, load, intake air temperature, fuel weight and Bosch Smoke readings were recorded once per hour. |
| 11 | The engine was run for 3 hours or until low fuel caused cycling, then shut down. |
| 12 | A vacuum bottle was used to remove lubricating oil from the crankcase. |
| 13 | The drain oil was weighed and the weight recorded. A one ounce oil sample was collected and labeled. |
| 14 | The fuel weight was recorded at the end of the test. The remaining test fuel was drained. |

At the end of the engine test, the sample of lubricating oil was examined by infrared spectroscopy to determine whether the soot dispersant additive that had been introduced into the fuel had accumulated in the lubricating oil in the crankcase. The 4 $cm^{-1}$ resolution infrared spectrum was acquired from 4000 to 600 $cm^{-1}$ using a 1.0 mm pathlength transmission cell. Succinimide bands indicative of the presence of the soot dispersant additive were found at 1704 and 1780 $cm^{-1}$ in the infrared difference spectrum.

EXAMPLE 3

A vehicle test study was conducted to demonstrate the long term fuel economy performance advantage of a diesel fuel composition containing soot dispersant additive of this invention. The diesel powered vehicles used in this test study are listed in Table 1 below.

TABLE 1

Test Vehicles

| Make | Model | Year | Engine |
|---|---|---|---|
| Volkswagon | Jetta | 2001 | 1.9 L |
| Chevrolet | R10 (light truck) | 1987 | 6.2 L |

The purpose of the test study was to determine whether the soot dispersant additive would help to maintain the condition of a diesel's engine oil such that the vehicle's fuel economy characteristics would be retained, and not degrade, over the course of the oil drain. The consistent, low dosage delivery of the soot dispersant additive to the lubricating oil in the crankcase is intended to continuously supplement the soot dispersing capacity of the oil during the service period. It is expected that the more severe the soot loading, the greater the potential for the soot dispersant additive to impart a lubricant performance benefit by controlling soot-mediated viscosity increase.

To that end, several mileage accumulation tests were carried out using a road simulator to amass service miles on the vehicles' respective oil charges. The reference fuel was a low sulfur diesel fuel blended with a detergent. The test fuel contained the same base fuel and detergent package, as well as the 309 ppm of the soot dispersant additive of Example 1.

A low dispersancy SAE 10W-30 passenger car motor oil was chosen for the evaluations in order to improve the vehicle tests' discrimination.

After the oil had been effectively "aged" on the road simulator, the vehicles' end-of-service-interval fuel economy was tested on a chassis dynamometer using the EPA-75 Cold Start Cycle and the Highway Fuel Economy Test (HWFET) Cycle protocols. Emissions were measured and fuel economy calculated for each vehicle using the carbon balance method as prescribed in the Code of Federal Regulations (CFR), Title 40.

Figure 2:
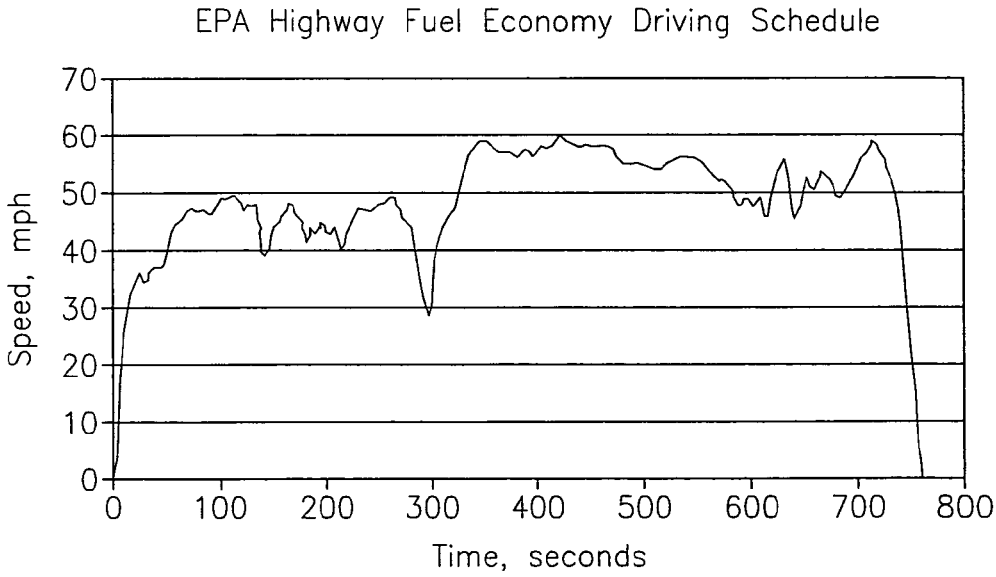

The test cycles were used to define the city (EPA-75) and highway fuel economy used for new vehicle fuel economy certification. The EPA-75 cycle consists of 11.1 miles of driving at an average speed of 21.3 mph and a maximum speed of 56.7 mph. The EPA-75 test cycle data are graphically presented in FIG. 1. The HWFET cycle consists of 10.2 miles of driving at an average speed of 48.1 mph and a maximum speed of 60 mph. The HWFET test results are graphically depicted in FIG. 2.

Fuel economy testing was also performed on a Clayton chassis dynamometer in conjunction with a Horiba emissions bench utilizing a constant volume sampling (CVS) unit. Fuel economy was calculated via emissions analysis using the carbon balance methods outlined in the CFR referred to above. Before taking emissions data on the test vehicles, the engines were run for one hour at 50 mph to allow the oil and transmission fluid temperatures to stabilize. Once a vehicle was fully warmed up, the evaluation sequence began. The one day test protocol consisted of one EPA-75 cycle followed by two HWFETs. The average of the two HWFETs is the reported result.

Vehicle data collected using the new oil, and the aged oils that had been subjected to the reference fuel and the fuel containing soot dispersant additive of the invention are shown in Tables 2 and 3. The weight percent soot in the used oils is also included.

TABLE 2

VW Jetta Test Data

| Fuel and Lubricant Tested | Mileage | Wt. # Soot | EPA-75 mpg | Average HWFET mpg |
|---|---|---|---|---|
| Fuel: Low Sulfur Base Diesel Fuel + Detergent only<br>Oil: New SAE 10W-30 | 0 | 0 | 33.20 | 50.78 |
| Fuel: Low Sulfur Base Diesel Fuel + Detergent only<br>Oil: Aged SAE 10W-30 | 9659 | 0.50 | 33.54 | 50.53 |
| Fuel: Low Sulfur Base Diesel Fuel + Detergent + 309 ppm Example 1<br>Oil: New SAE 10W-30 | 0 | 0 | 32.91 | 50.40 |
| Fuel: Low Sulfur Base Diesel Fuel + Detergent + 309 ppm Example 1<br>Oil: Aged SAE 10W-30 | 9651 | 0.60 | 32.90 | 49.84 |
| Aged Oil Fuel Economy Change When Vehicle is Operated with Fuel Containing Example 1 | | | −1.91% | −1.37% |

TABLE 3

Chevrolet R10 Test Data

| Fuel and Lubricant Tested | Mileage | Wt. # Soot | EPA-75 mpg | Average HWFET mpg |
|---|---|---|---|---|
| Fuel: Low Sulfur Base Diesel Fuel + Detergent only<br>Oil: New SAE 10W-30 | 0 | 0 | 18.60 | 25.28 |
| Fuel: Low Sulfur Base Diesel Fuel + Detergent only<br>Oil: Aged SAE 10W-30 | 7379 | 3.70 | 18.10 | 24.44 |
| Fuel: Low Sulfur Base Diesel Fuel + Detergent + 309 ppm Example 1<br>Oil: New SAE 10W-30 | 0 | 0 | 18.67 | 25.41 |
| Fuel: Low Sulfur Base Diesel Fuel + Detergent + 309 ppm Example 1<br>Oil: Aged SAE 10W-30 | 6952 | 3.40 | 19.03 | 26.30 |
| Aged Oil Fuel Economy Change When Vehicle is Operated with Fuel Containing Example 1 | | | +5.14% | +7.61% |

Regardless of the fuel used, the VW Jetta generated very little soot by the end of each ~9650 mile test on the road simulator. At approximately 0.5 weight percent end-of-test soot, the engine oil was not severely stressed with respect to soot loading. Consequently there was little opportunity for the dispersant fuel additive to have an effect on the lubricant's performance, and the Jetta's fuel economy results were not strikingly different when operated on the aged oils that were exposed to the reference fuel or the test fuel containing soot dispersant additive of the invention.

In contrast, the long-term fuel economy benefit derived from using the fuel dispersant additive over the extended drain interval was substantial in the case of the high soot producing light duty truck. The Chevrolet's end-of-test soot levels were consistently greater than 3 weight percent. Examining the data obtained for the new and aged oils exposed to the reference fuel only, it appears that this concentration of soot depleted the oil's innate soot dispersing capacity and the fuel economy of the vehicle decreases. When this vehicle was operated for approximately 7000 miles on the test fuel containing soot dispersant additive of the invention, the soot concentration was still greater than 3 weight percent, but the fuel economy characteristics of the engine oil were retained. Furthermore, the fuel economy of the aged oil containing soot dispersant additive improved by 5.14% in the EPA-75 Test cycle and 7.61% in the HWFET relative to the fuel economy measurements obtained for the used oil exposed to reference fuel alone. As such, it is believed that the slowly metered introduction of the fuel dispersant into the engine oil helped sustain the lubricant's viscometrics. Overall, the end of the 7000 mile test on diesel fuel containing soot dispersant additive in accordance with the invention was marked with significant fuel economy maintenance benefit.

While the above description contains many specifics, these specifics should not be construed as limitations of the invention, but merely as exemplifications of preferred embodiments thereof. Those skilled in the art will envision many other embodiments within the scope and spirit of the invention as defined by the claims appended hereto.

What is claimed is:

1. A method for improving the drain interval of a diesel engine oil in a diesel engine comprising supplying to the diesel engine a diesel fuel composition comprising (a) a major amount of a diesel fuel and (b) an effective amount of a soot dispersant additive capable of being delivered to the diesel engine oil, wherein the soot dispersant additive is a copolymer of ethylene and a $C_3$-$C_{10}$ alpha-monoolefin having a number average molecular weight ranging from about 5,500 to about 60,000 on which has been grafted an ethylenically unsaturated carboxylic acid and/or anhydride thereof in the ratio of at least about 1.8 molecules of a carboxylic acid function per molecule of said copolymer which is then further derivatized with at least one amino-aromatic polyamine compound selected from the group consisting of:

(a) N-arylphenylenediamine of the formula:

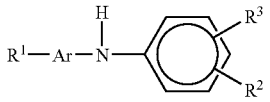

wherein Ar is aromatic and $R^1$ is H or —NHaryl, —NHarylalkyl, a branched or straight chain radical having from 4 to about 24 carbon atoms that is alkyl, alkenyl, alkoxyl, aralkyl alkaryl, hydroxyalkyl or aminoalkyl; $R^2$ is —$NH_2$, —[NH$(CH_2)_n$—]$_m$—$NH_2$, —$CH_2$—$(CH_2)_n$—$NH_2$, —$CH_2$-aryl-$NH_2$-aryl-$NH_2$ in which n and m each independently has a value of from 1 to about 10; and, $R^3$ is H or an alkyl, alkenyl, alkoxy, aralkyl or alkaryl radical having from 4 to about 24 carbon atoms, (b) aminocarbazole of the formula:

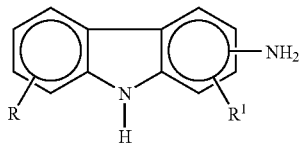

wherein R and $R^1$ each independently represents H or an alkyl or alkenyl radical having from 1 to about 14 carbon atoms, (c) aminoindole of the formula:

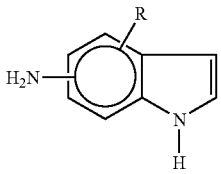

wherein R represents H or an alkyl radical having from 1 to about 14 atoms, (d) amino-indazolinone of the formula:

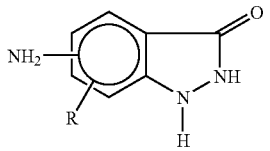

wherein R is H or an alkyl radical having from 1 to about 14 carbon atoms, and (e) aminoperimidine of the formula:

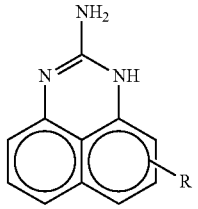

wherein R represents H or an alkyl radical having from 1 to about 14 atoms.

2. The method of claim 1, wherein the ethylene and $C_3$-$C_{10}$ alpha-monoolefin are copolymerized with at least one polyene monomer selected from the group consisting of nonconjugated dienes and nonconjugated trienes to provide a terpolymer.

3. The method of claim 1, wherein the $C_3$-$C_{10}$ alpha-monoolefin is propylene.

4. The method of claim 1, wherein the ethylenically unsaturated carboxylic acid anhydride is maleic anhydride.

5. The method of claim 1, wherein the at least one amino-aromatic polyamine compound is an N-arylphenylenediamine.

6. The method of claim 1, wherein the N-arylphenylenediamine is N-phenyl-p-phenylenediamine.

7. The method of claim 1, wherein the number average molecular weight of the copolymer is from about 6,000 to about 20,000.

8. The method of claim 1, wherein the number average molecular weight of the copolymer is from about 7,000 to about 15,000.

9. The method of claim 1, wherein the amino-aromatic polyamine compound is reacted with the copolymer containing the grafted carboxylic acid function in a ratio of about 0.5:1 to about 1.1:1 molar equivalence of amino-aromatic polyamine compound to copolymer containing the grafted carboxylic acid function.

10. The method of claim 1, wherein the amino-aromatic polyamine compound is reacted with the copolymer containing the grafted carboxylic acid function in a ratio of about 0.9:1 to about 1:1 molar equivalence of amino-aromatic polyamine compound to copolymer containing the grafted carboxylic acid function.

11. The method of claim 1, wherein the copolymer is obtained by copolymerizing ethylene and propylene, the copolymer is grafted with maleic anhydride to provide carboxylic acid function and the grafted copolymer is reacted with N-phenyl-p-phenylenediamine.

12. The method of claim 1, wherein the effective amount of the soot dispersant additive is about 50 ppm to about 5,000 ppm.

13. The method of claim 1, wherein the effective amount of the soot dispersant additive is about 100 to about 2,000 ppm.

14. The method of claim 1, wherein at least one other diesel fuel additive is added to the diesel fuel.

15. The method of claim 14, wherein the at least one other diesel fuel additive is selected from the group consisting of other soot dispersant additives, detergents, cetane improvers, antioxidants, carrier fluids, metal deactivators, dyes, markers, corrosion inhibitors, biocides, antistatic additives, drag reducing agents, demulsifiers, dehazers, anti-icing additives, lubricity additives, combustion improvers and mixtures thereof.

16. The method of claim 1, wherein the soot dispersant additive is continuously replenished in the diesel engine oil as the soot dispersant additive is consumed during normal course of engine operation.

* * * * *